US010490155B2

(12) United States Patent
Uchiyama

(10) Patent No.: US 10,490,155 B2
(45) Date of Patent: Nov. 26, 2019

(54) LIQUID CRYSTAL DISPLAY DEVICE

(71) Applicant: JVK KENWOOD CORPORATION, Yokohama-shi, Kanagawa (JP)

(72) Inventor: Yuji Uchiyama, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 38 days.

(21) Appl. No.: 15/874,644

(22) Filed: Jan. 18, 2018

(65) Prior Publication Data

US 2018/0211631 A1 Jul. 26, 2018

(30) Foreign Application Priority Data

Jan. 24, 2017 (JP) ..... 2017-010004

(51) Int. Cl.
*G09G 3/36* (2006.01)

(52) U.S. Cl.
CPC ..... *G09G 3/3696* (2013.01); *G09G 3/3607* (2013.01); *G09G 3/3648* (2013.01); *G09G 3/3688* (2013.01); *G09G 2310/0283* (2013.01); *G09G 2310/063* (2013.01); *G09G 2310/08* (2013.01)

(58) Field of Classification Search
CPC .... A61K 31/05; A61K 9/2018; A61K 9/2072; A61K 9/2095
USPC ..... 345/98, 690
See application file for complete search history.

(56) References Cited

U.S. PATENT DOCUMENTS

2005/0168427 A1* 8/2005 Odom ..... G09G 3/2011 345/98
2008/0316234 A1* 12/2008 Toriumi ..... G09G 3/002 345/690
2009/0161969 A1* 6/2009 Hara ..... H04N 19/63 382/232
2009/0180365 A1* 7/2009 Kimura ..... G11B 20/00086 369/47.17
2013/0201361 A1* 8/2013 Yang ..... H04N 5/23229 348/222.1
2018/0211631 A1* 7/2018 Uchiyama ..... G09G 3/3607

FOREIGN PATENT DOCUMENTS

JP H6-178238 A 6/1994

* cited by examiner

*Primary Examiner* — Tony O Davis
(74) *Attorney, Agent, or Firm* — Nath, Goldberg & Meyer; Jerald L. Meyer; Stanley N. Protigal

(57) ABSTRACT

A liquid crystal display device includes a video signal processor, a ramp waveform signal generation circuit, and a liquid crystal display element. The video signal processor generates a non-inverted video signal in which video data is not bit-inverted, and an inverted video signal in which the video data is bit-inverted. The ramp waveform signal generation circuit generates a ramp waveform signal having a ramp waveform of a sawtooth wave. In the liquid crystal display element, a plurality of pixels having a liquid crystal are arranged, and a first driving voltage decided based on the non-inverted video signal and the ramp waveform signal and a second driving voltage decided based on the inverted video signal and the ramp waveform signal are alternately applied to the liquid crystal.

1 Claim, 6 Drawing Sheets

LIQUID CRYSTAL DISPLAY DEVICE

CROSS REFERENCE TO RELATED APPLICATION

This application is based upon and claims the benefit of priority under 35 U.S.C. § 119 from Japanese Patent Application No. 2017-010004, filed on Jan. 24, 2017, the entire contents of which are incorporated herein by reference.

BACKGROUND

The present disclosure relates to a liquid crystal display device.

A liquid crystal display device can perform gradation display of an image by driving liquid crystals based on gradation data of each pixel.

Japanese Unexamined Patent Application Publication (JP-A) No. 6-178238 discloses that each pixel data of one horizontal line and output of a counter are compared with each other and a ramp waveform signal is sampled at a timing at which both of them coincide with each other. An analog voltage of the sampled ramp waveform signal is supplied to pixels, so that an image is displayed with gradations.

SUMMARY

The liquid crystal display device can invert, for each frame, a ramp waveform of a sawtooth wave (hereinafter, referred to as a normal sawtooth wave) having a voltage which gently rises and then rapidly falls, and a ramp waveform of a sawtooth wave (hereinafter, referred to as a reverse sawtooth wave) having a voltage which gently falls and then rapidly rises, thereby AC-driving a liquid crystal. The liquid crystal is AC-driven, so that it is possible to prevent persistence of the liquid crystal.

There is a case where ringing occurs in the ramp waveform when a voltage rapidly falls or rapidly rises. Particularly, in the case of the ramp waveform of the normal sawtooth wave, there is a case where the maximum amplitude of the ringing exceeds the power supply voltage of a low potential side power supply of a liquid crystal display element. Since the maximum amplitude of the ringing exceeds a threshold value of a diode constituting a protection diode circuit of the liquid crystal display element when exceeding the power supply voltage of the low potential side power supply of the liquid crystal display element, latch-up occurs in the diode.

In order to prevent the latch-up in the diode, it is necessary to set the low potential side voltage of the ramp waveform to be high such that the maximum amplitude of the ringing does not exceed the threshold value. However, when the low potential side voltage of the ramp waveform is set to be high, since the amplitude of the ramp waveform is reduced, a modulation degree of the liquid crystal is reduced, so that a dynamic range of contrast of a display image becomes narrow.

An aspect of the embodiment provides a liquid crystal display device including: a video signal processor configured to generate a non-inverted video signal in which video data is not bit-inverted and an inverted video signal in which the video data is bit-inverted; a ramp waveform signal generation circuit configured to generate a ramp waveform signal having a ramp waveform of a sawtooth wave; and a liquid crystal display element in which a plurality of pixels having a liquid crystal are arranged, and a first driving voltage decided based on the non-inverted video signal and the ramp waveform signal and a second driving voltage decided based on the inverted video signal and the ramp waveform signal are alternately applied to the liquid crystal.

DETAILED DESCRIPTION

Figure 1:
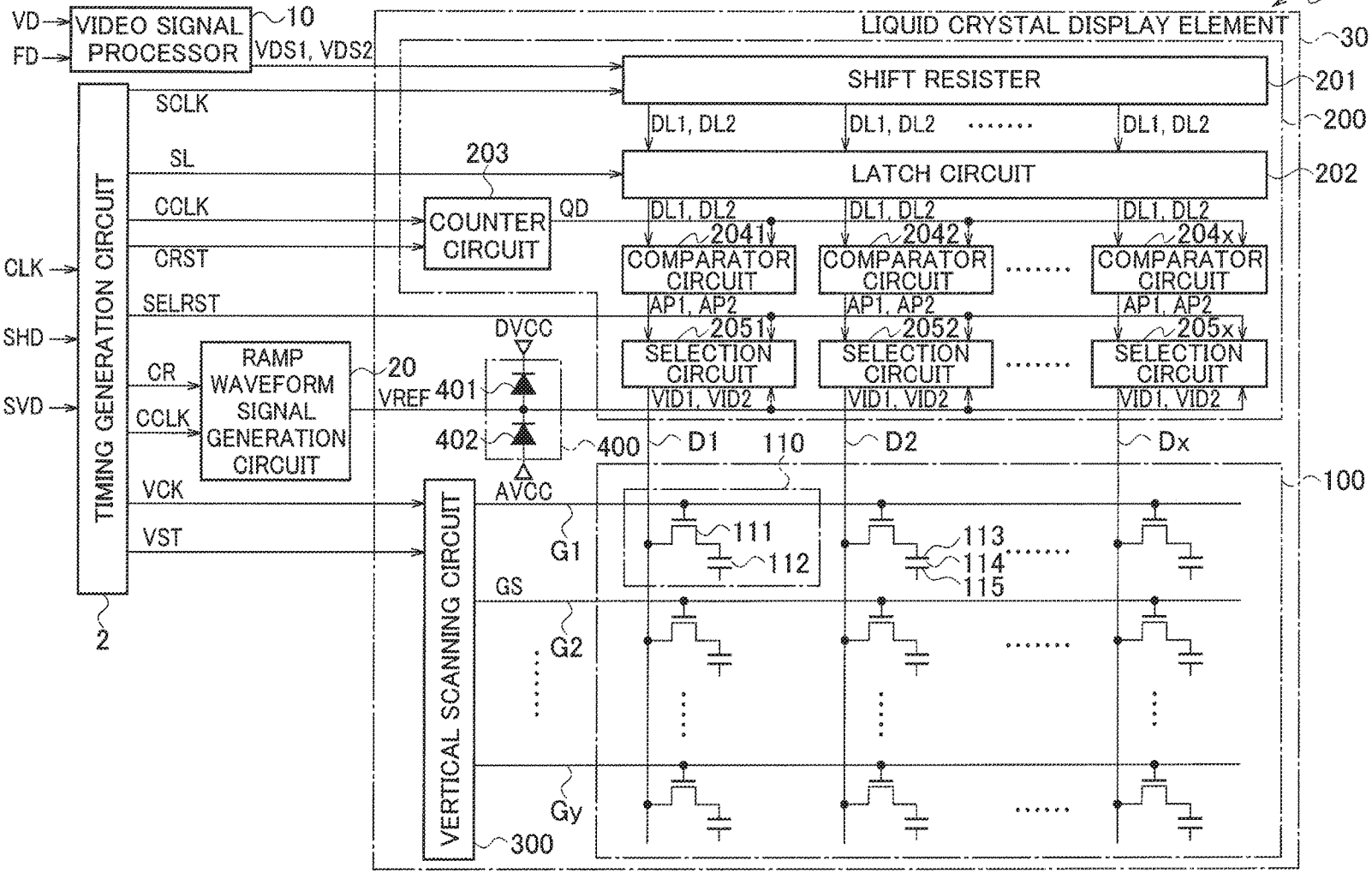
FIG. 1 is a configuration diagram illustrating a liquid crystal display device according to at least one embodiment.
Figure 2:
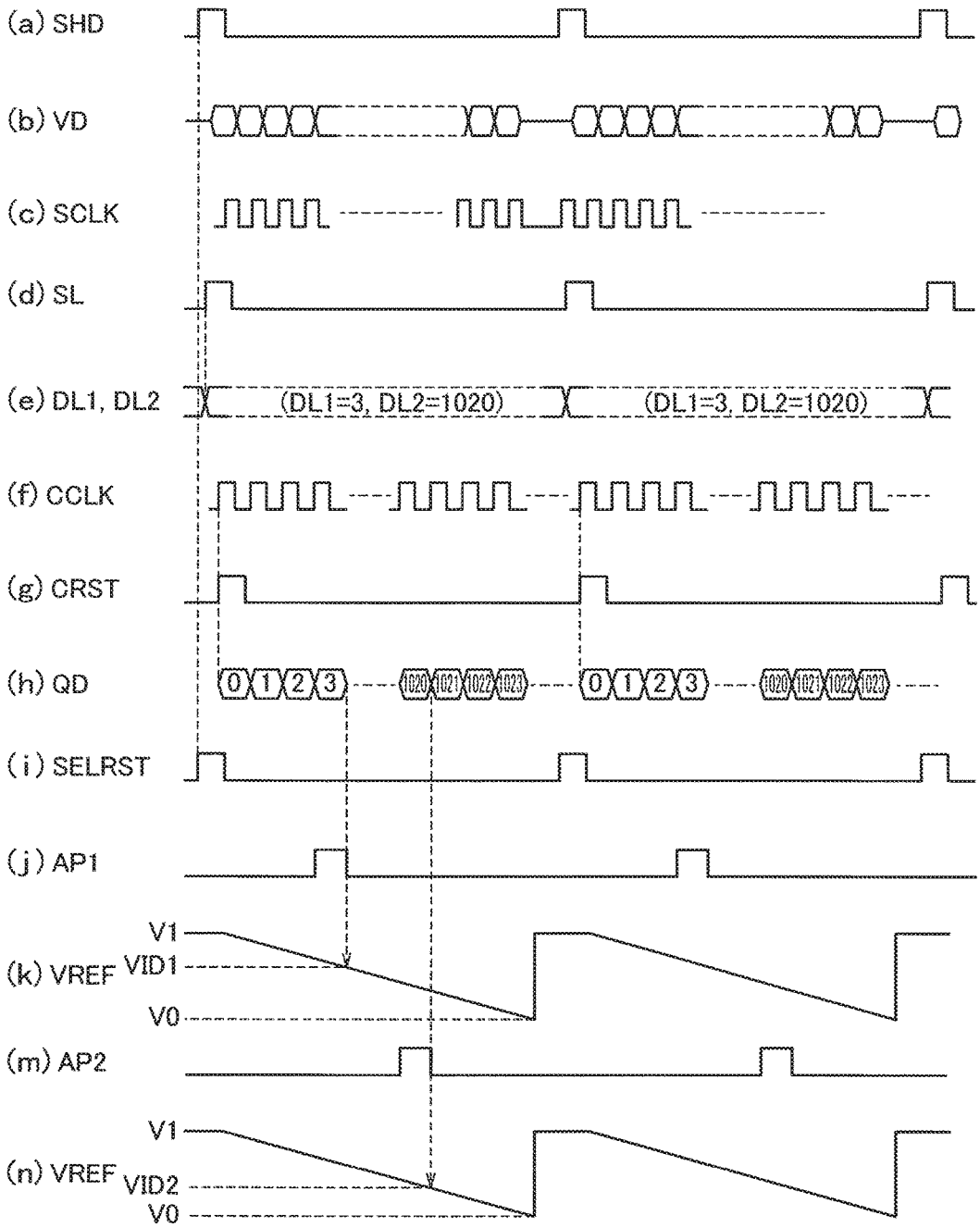
FIG. 2 is a timing chart illustrating a relation of signals in the liquid crystal display device according to the embodiment.

A liquid crystal display device according to an embodiment will be described using FIG. 1 to FIG. 5. FIG. 1 illustrates a configuration example of a liquid crystal display device of an embodiment. FIG. 2 is a timing chart illustrating a relation of signals in the liquid crystal display device. As illustrated in FIG. 1, a liquid crystal display device 1 includes a video signal processor 10, a timing generation circuit 2, a ramp waveform signal generation circuit 20, and a liquid crystal display element 30.

The liquid crystal display element 30 includes a display element unit 100, a horizontal scanning circuit 200, a vertical scanning circuit 300, and a protection diode circuit 400. The display element unit 100 has a plurality of (x×y) pixels 110 arranged in a matrix shape at intersection parts between a plurality of (x) column data lines D (D1 to Dx) arranged in a horizontal direction and a plurality of (y) row scanning lines G (G1 to Gy) arranged in a vertical direction.

Each pixel 110 has a pixel selection transistor 111 and a liquid crystal driving section 112. The pixel selection transistor 111 has a gate connected to the row scanning line G, a drain connected to the column data line D, and a source connected to the liquid crystal driving section 112. As the pixel selection transistor 111, an NMOS transistor may be used.

The liquid crystal driving section 112 has a pixel electrode 113, a liquid crystal 114, and a common electrode 115. The pixel electrode 113 is connected to the source of the pixel selection transistor 111. The common electrode 115 is an electrode common to all pixels and receives a common voltage. The liquid crystal 114 is filled in a gap between the pixel electrode 113 and the common electrode 115, and is driven in accordance with a differential voltage between a driving voltage VID applied to the pixel electrode 113 and a voltage applied to the common electrode 115.

The horizontal scanning circuit 200 is connected to the pixels 110 of the display element unit 100 via the column data lines D1 to Dx. For example, the column data line D1 is connected to y pixels 110 of the first column of the display element unit 100. The column data line D2 is connected to y pixels 110 of the second column of the display element unit 100, and the column data line Dx is connected to y pixels 110 of the $x^{th}$ column of the display element unit 100.

The horizontal scanning circuit 200 has a shift resister 201, a latch circuit 202, a counter circuit 203, x comparator circuits 204 (2041 to 204*x*), and x selection circuits 205 (2051 to 205*x*). The selection circuit 205 has a CMOS structure.

The protection diode circuit 400 configures a diode clamp circuit having a diode 401 connected to a high potential side power supply DVCC and a diode 402 connected to a low potential side power supply AVCC.

Figure 3:
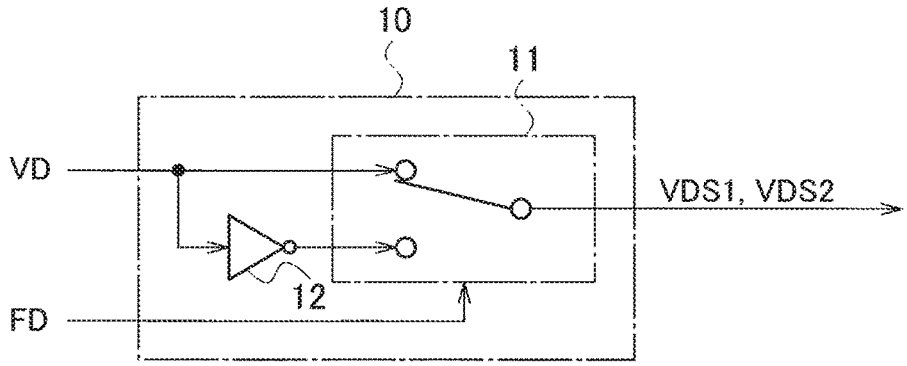
FIG. 3 is a configuration diagram illustrating a video signal processor of the liquid crystal display device according to the embodiment.

As illustrated in FIG. 3, the video signal processor 10 has a switch 11 and an inverter 12. The video signal processor 10 receives video data VD and a frame synchronization signal FD which are digital signals. On the frame synchronization signal FD, the video signal processor 10 alternately performs bit inversion and non-inversion of the video data VD in units of frames, and outputs a video signal VDS to the liquid crystal display element 30.

For example, when FD is 0, the video signal processor 10 generates a video signal (hereinafter, referred to as a non-inverted video signal) VDS1 in which the video data VD is not bit-inverted by the switch 11, and outputs the non-inverted video signal VDS1 to the shift resister 201 of the horizontal scanning circuit 200 of the liquid crystal display element 30. When FD is 1, the video signal processor 10 switches the switch 11 and generates a video signal (hereinafter, referred to as an inverted video signal) VDS2 in which the video data VD is bit-inverted by the inverter 12, and outputs the inverted video signal VDS2 to the shift resister 201.

As illustrated in FIG. 1, the timing generation circuit 2 receives a clock signal CLK, a vertical synchronization signal SVD, and a horizontal synchronization signal SHD illustrated in a timing chart (a) of FIG. 2. Based on the clock signal CLK and the horizontal synchronization signal SHD, the timing generation circuit 2 generates a shift clock signal SCLK illustrated in a timing chart (c) of FIG. 2, a latch signal SL illustrated in a timing chart (d) of FIG. 2, a counter clock signal CCLK illustrated in a timing chart (f) of FIG. 2, a counter reset signal CRST illustrated in a timing chart (g) of FIG. 2, a counter reset signal CR which is synchronized with the horizontal synchronization signal SHD, and an all-pixel reset signal SELRST illustrated in a timing chart (i) of FIG. 2. Based on the clock signal CLK, the horizontal synchronization signal SHD, and the vertical synchronization signal SVD, the timing generation circuit 2 generates a row selection signal VCK and a vertical reset signal VST.

The timing generation circuit 2 outputs the shift clock signal SCLK to the shift resister 201 of the horizontal scanning circuit 200 of the liquid crystal display element 30. The timing generation circuit 2 outputs the latch signal SL to the latch circuit 202. The timing generation circuit 2 outputs the counter clock signal CCLK and the counter reset signal CRST to the counter circuit 203. The timing generation circuit 2 outputs the all-pixel reset signal SELRST to the selection circuits 205 (2051 to 205*x*).

The timing generation circuit 2 outputs the row selection signal VCK and the vertical reset signal VST to the vertical scanning circuit 300. The timing generation circuit 2 outputs the counter reset signal CR and the counter clock signal CCLK to the ramp waveform signal generation circuit 20.

Figure 4:
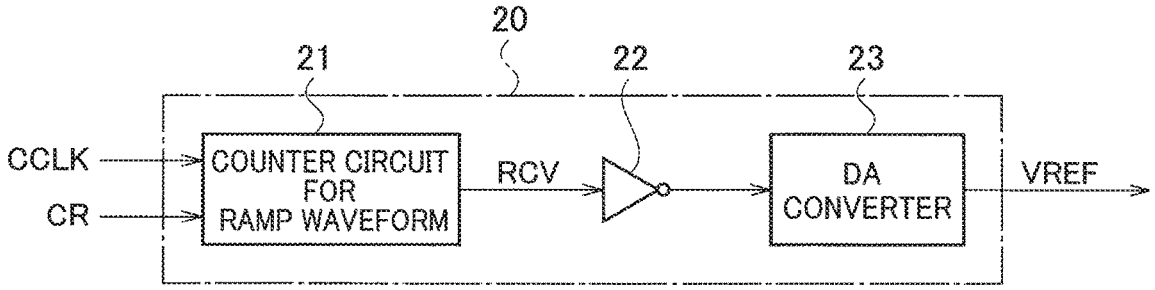
FIG. 4 is a configuration diagram illustrating a ramp waveform signal generation circuit of the liquid crystal display device according to the embodiment.

As illustrated in FIG. 4, the ramp waveform signal generation circuit 20 has a counter circuit 21 for a ramp waveform, an inverter 22, and a DA converter 23. To the counter circuit 21 for a ramp waveform, the counter clock signal CCLK and the counter reset signal CR are inputted. The counter reset signal CR is inputted, so that the counter circuit 21 for a ramp waveform is reset.

The counter circuit 21 for a ramp waveform is reset, counts up the counter clock signal CCLK, and then outputs a count value RCV for a ramp waveform to the inverter 22. The inverter 22 performs bit inversion of the count value RCV for a ramp waveform. The count value RCV for a ramp waveform has n bits, that is, an integral value of 0 to $(2^n-1)$. For example, when the count value RCV for a ramp waveform has 10 bits (n=10), it has an integral value of 0 to 1,023.

The DA converter 23 performs DA conversion of the count value RCV for a ramp waveform subjected to the bit inversion, thereby generating a ramp waveform signal VREF which is an analog signal having a ramp waveform of a reverse sawtooth wave having a voltage which gently falls and then rapidly rises. Then, the DA converter 23 outputs the ramp waveform signal VREF to the selection circuits 205 (2051 to 205*x*) of the horizontal scanning circuit 200 of the liquid crystal display element 30. As illustrated in timing charts (k) and (n) of FIG. 2, the ramp waveform signal VREF has an analog ramp waveform of a periodic sweep signal which changes in a voltage falling direction from a high voltage level V1 of white display to a low voltage level V0 of black display in the pixel 110 with a cycle of one horizontal scanning period.

To the shift resister 201, the non-inverted video signal VDS1 and the inverted video signal VDS2 are alternately inputted from the video signal processor 10 in units of frames. Furthermore, to the shift resister 201, the shift clock signal SCLK is inputted from the timing generation circuit 2. Based on the shift clock signal SCLK, the shift resister 201 sequentially inputs the non-inverted video signal VDS1 and the inverted video signal VDS2 as a non-inverted gradation signal DL1 and an inverted gradation signal DL2 corresponding to the x pixels 110 of one row scanning line G in units of one horizontal scanning period.

Each of the non-inverted gradation signal DL1 and the inverted gradation signal DL2 has n-bit gradation data. For example, when n is 10, an image can be displayed with 1,024 gradations for each pixel 110. When a gradation value of the non-inverted gradation signal DL1 is 3, a gradation value of the inverted gradation signal DL2 is 1,020.

The shift resister 201 sequentially inputs the n-bit gradation data in a parallel manner and shifts the n-bit gradation data. For example, when x is 1,920 in correspondence with full high definition in the display element unit 100, the shift resister 201 inputs and shifts n-bit gradation data corresponding to each of 1,920 pixels 110 in one horizontal scanning period.

To the latch circuit 202, the latch signal SL is inputted in one horizontal blanking period. Based on the latch signal SL, the latch circuit 202 receives the non-inverted gradation signal DL1 and the inverted gradation signal DL2 corresponding to x pixels 110 of one row scanning line G from the shift resister 201 in one horizontal scanning period. The latch circuit 202 holds the n-bit gradation data corresponding to each of the received x pixels 110 in the next one horizontal scanning period.

To the counter circuit 203, the counter clock signal CCLK and the counter reset signal CRST are inputted. Based on the counter clock signal CCLK, the counter circuit 203 sequentially counts up a count value QD of n bits illustrated in a timing chart (h) of FIG. 2. In this way, the counter circuit 203 outputs $2^n$ count values QD (0 to $(2^n-1)$) to the comparator circuits 204 (2041 to 204*x*) for each one horizontal scanning period. Accordingly, the counter circuit 203 outputs the count values QD having a gradation value equal to that of the gradation data to the comparator circuits 204.

The comparator circuits 204 (2041 to 204*x*) correspond to the column data lines D (D1 to Dx), respectively. To each of the comparator circuits 204, the count value QD is inputted from the counter circuit 203 and the non-inverted gradation signal DL1 and the inverted gradation signal DL2 corresponding to the pixels 110 are inputted from the latch circuit 202.

Each of the comparator circuits 204 compares the gradation data of the non-inverted gradation signal DL1 with the count value QD for each bit, generates a coincident pulse signal AP1 illustrated in a timing chart (j) of FIG. 2 when both of them coincide with each other, and outputs the coincident pulse signal AP1 to a corresponding selection circuit 205. That is, the coincident pulse signal AP1 is generated based on the non-inverted gradation signal DL1.

Each of the comparator circuits 204 compares the gradation data of the inverted gradation signal DL2 with the count value QD for each bit, generates a coincident pulse signal AP2 illustrated in a timing chart (m) of FIG. 2 when both of them coincide with each other, and outputs the coincident pulse signal AP2 to a corresponding selection circuit 205. That is, the coincident pulse signal AP2 is generated based on the inverted gradation signal DL2.

When the non-inverted gradation signal DL1 is inputted, for example, and when the gradation value of the non-inverted gradation signal DL1 is 3, the comparator circuit 204 outputs the coincident pulse signal AP1 to the selection circuit 205 at a timing at which the count value QD is 3. When the inverted gradation signal DL2 is inputted, for example, and when the gradation value of the inverted gradation signal DL2 is 1,020, the comparator circuit 204 outputs the coincident pulse signal AP2 to the selection circuit 205 at a timing at which the count value QD is 1,020.

The selection circuits 205 (2051 to 205*x*) correspond to the comparator circuits 204 (2041 to 204*x*), respectively. The selection circuits 205 (2051 to 205*x*) are connected to the column data lines D (D1 to Dx), respectively. For example, the selection circuit 2051 is connected to the y pixels 110 of the first column of the display element unit 100 via the column data line D1. Furthermore, the selection circuit 2052 is connected to the y pixels 110 of the second column of the display element unit 100 via the column data line D2. The selection circuit 205*x* is connected to the y pixels 110 of the $x^{th}$ column of the display element unit 100 via the column data line Dx.

To each of the selection circuits 205, the coincident pulse signals AP1 and AP2 are inputted from the corresponding comparator circuits 204, the all-pixel reset signal SELRST is inputted from the timing generation circuit 2, and the ramp waveform signal VREF is inputted from the ramp waveform signal generation circuit 20.

Each selection circuit 205 has an analog switch for starting and ending sampling. When the all-pixel reset signal SELRST is inputted from the timing generation circuit 2 during one horizontal blanking period, each analog switch is turned on, so that each selection circuit 205 starts sampling of the ramp waveform signal VREF. When each analog switch is turned off at falling timings of the coincident pulse signals AP1 and AP2, each selection circuit 205 ends the sampling.

The selection circuits 205 respectively outputs the sampled ramp waveform signal VREF to corresponding column data lines D as driving voltages VID1 and VID2 (analog voltages) during a period from the input of the all-pixel reset signal SELRST to the falling of the coincident pulse signals AP1 and AP2 in units of one horizontal scanning period. The selection circuits 205 end the sampling at the falling timings of the coincident pulse signals AP1 and AP2, thereby deciding the driving voltages VID1 and VID2 to be outputted to the column data line D1.

The coincident pulse signal AP1 is a signal generated based on the non-inverted video signal VDS1. The driving voltage VID1 (a first driving voltage) is a voltage decided based on the non-inverted video signal VDS1 and the ramp waveform signal VREF. The coincident pulse signal AP2 is a signal generated based on the inverted video signal VDS2. The driving voltage VID2 (a second driving voltage) is a voltage decided based on the inverted video signal VDS2 and the ramp waveform signal VREF. For example, the selection circuits 2051 outputs the sampled ramp waveform signal VREF to the column data line D1 as the driving voltages VID1 and VID2 at the falling timings of the coincident pulse signals AP1 and AP2 outputted from the comparator circuit 2041.

When the coincident pulse signal AP1 is inputted at a timing based on the non-inverted gradation signal DL1, the selection circuits 205 perform sampling toward low gradation (black) from high gradation (white). Furthermore, when the coincident pulse signal AP2 is inputted at a timing based on the inverted gradation signal DL2, the selection circuits 205 perform sampling toward high gradation (white) from low gradation (black). In this way, the driving voltage VID1 and the driving voltage VID2 are alternately applied to the pixel electrode 113 of the liquid crystal driving section 112 in units of frames, so that the liquid crystal 114 can be AC-driven.

Figure 5:
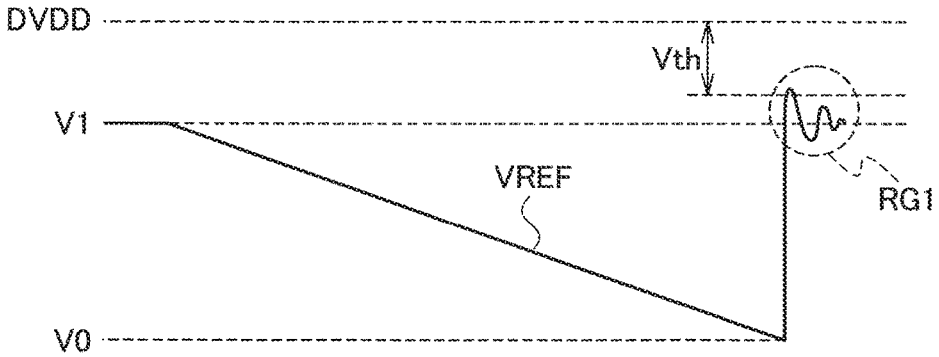
FIG. 5 is a diagram for explaining ringing occurring in a ramp waveform signal.

Ringing occurring in the ramp waveform signal VREF will be described using FIG. 5. The ramp waveform signal VREF gently falls from a high voltage level V1 to a low voltage level V0 and then rapidly rises to the high voltage level V1. When the ramp waveform signal VREF rapidly rises to the high voltage level V1 from the low voltage level V0, ringing RG1 occurs.

Since the selection circuit 205 has the CMOS structure, the selection circuit 205 can receive the ramp waveform signal VREF at a full scale from a potential (a high potential) DVDD of the high potential side power supply DVCC to a potential (a low potential) AVDD of the low potential side power supply AVCC, thereby sampling the ramp waveform signal VREF. On the other hand, when the pixel selection transistor 111 employs the CMOS structure, two transistors are required for each pixel 110, resulting in an increase in the pixel size. In this regard, the pixel selection transistor 111 employs an NMOS transistor, so that the pixel selection transistor 111 can be configured with one transistor.

The pixel selection transistor 111 switches to an ON state and an OFF state in accordance with a voltage level of a gate signal GS inputted to the gate from the vertical scanning circuit 300 via the row scanning line G. The gate signal GS is set to be inputted to the pixel selection transistor 111 at a signal level from the high potential DVDD to the low potential AVDD. On the other hand, when the driving voltages VID1 and VID2 inputted to the drain from the selection circuit 205 via the column data line D exceed a threshold value $V_{th}$ of the pixel selection transistor 111, the pixel selection transistor 111 does not operate normally.

Accordingly, in order to allow the pixel selection transistor 111 to operate normally, the driving voltages VID1 and VID2 are inputted to the pixel selection transistor 111 at a signal level from a potential (DVDD−$V_{th}$) to the potential AVDD. Therefore, the high voltage level V1 of the ramp waveform signal VREF is set to a potential (V1<(DVDD−$V_{th}$)) lower than the potential (DVDD−$V_{th}$). In this way, even though the ringing RG1 occurs when the ramp waveform signal VREF rapidly rises to the high voltage level V1 from the low voltage level V0, it is possible to suppress the maximum amplitude of the ringing RG1 in a range from the potential DVDD to the potential (DVDD−$V_{th}$), so that it is possible to normally operate the pixel selection transistor 111.

Comparative Example

Figure 6:
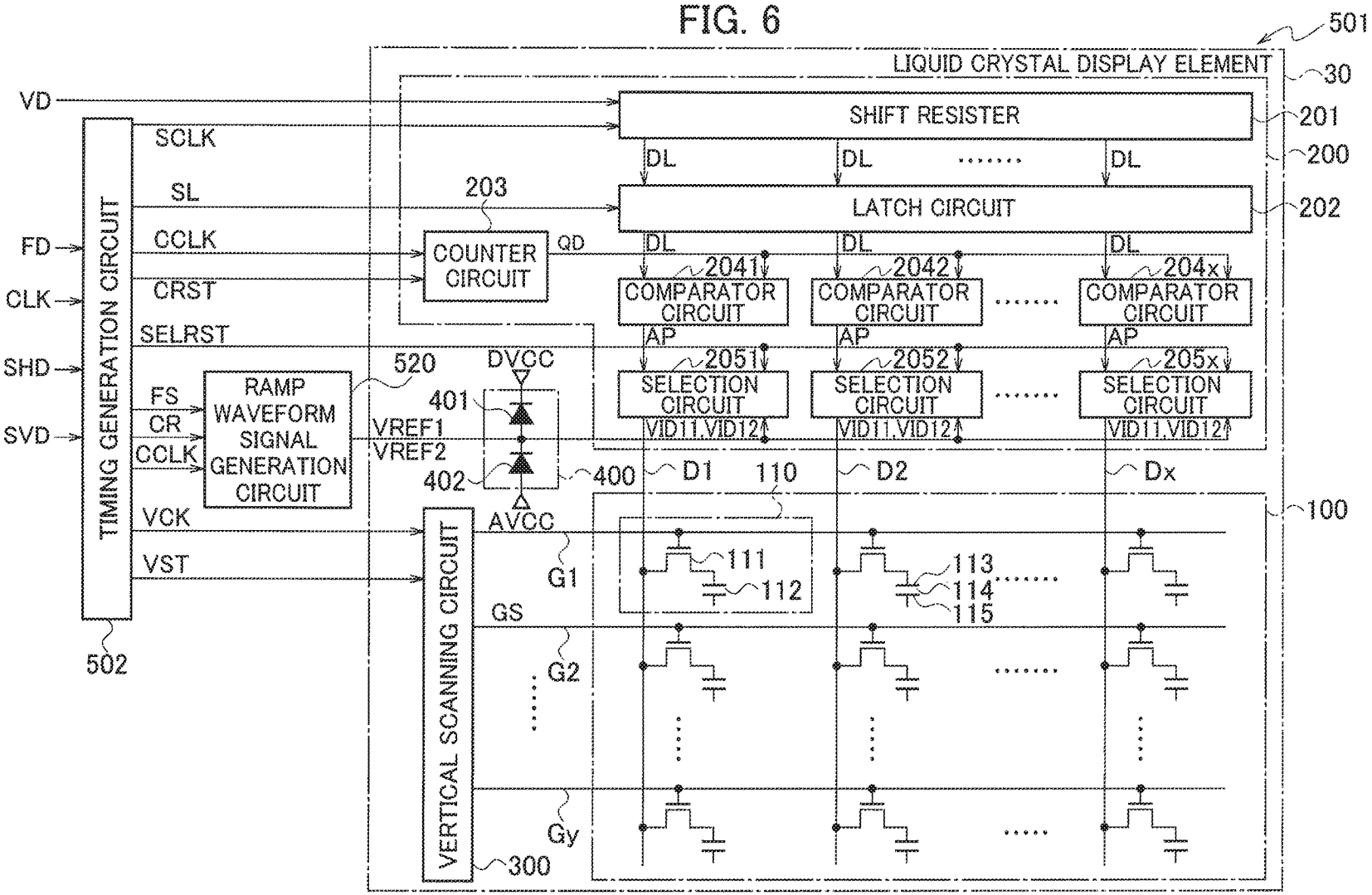
FIG. 6 is a configuration diagram illustrating a liquid crystal display device of a comparative example.
Figure 7:
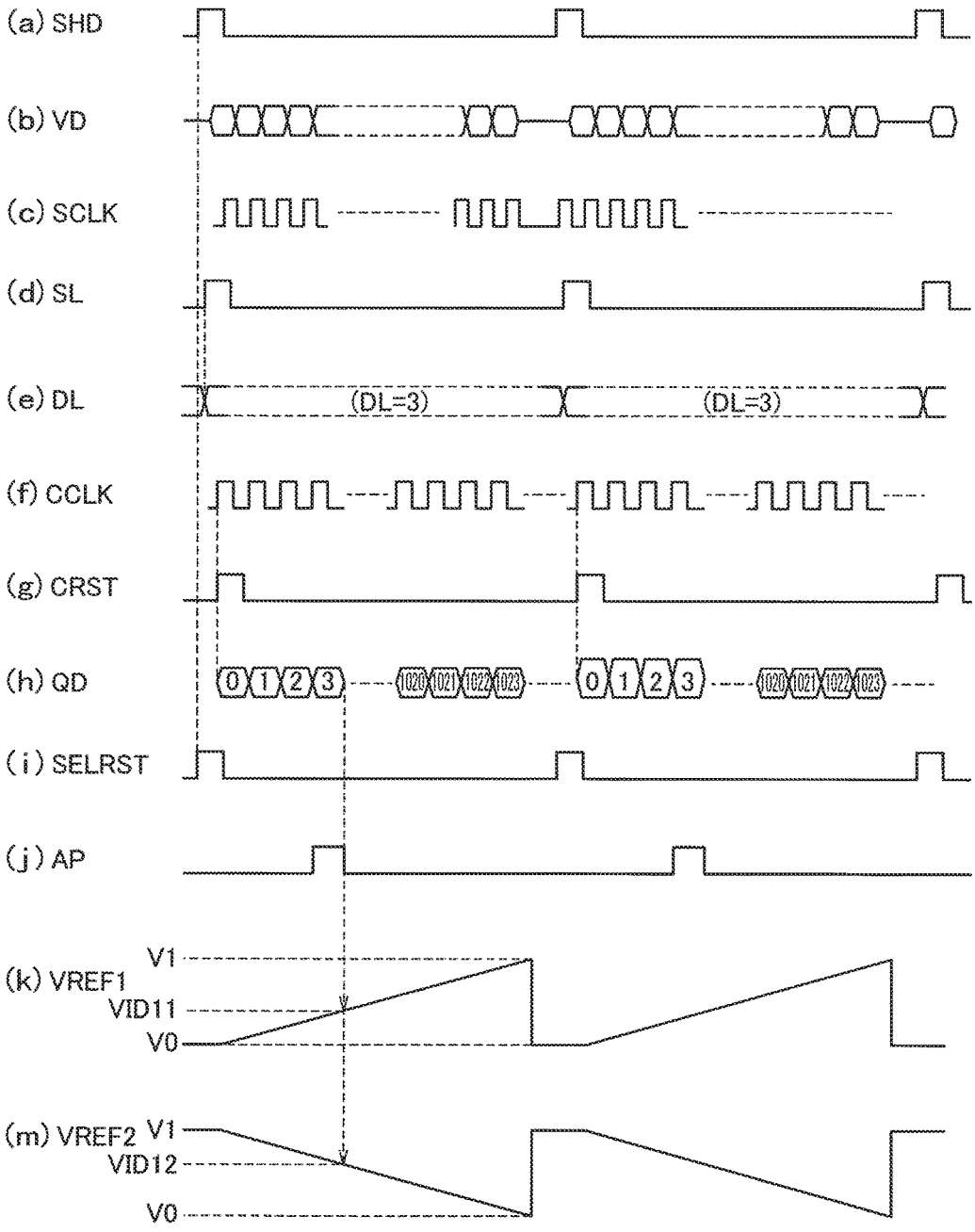
FIG. 7 is a timing chart illustrating a relation of signals in the liquid crystal display device of the comparative example.

A liquid crystal display device of a comparative example will be described using FIG. 6 to FIG. 9. FIG. 6 illustrates a configuration example of the liquid crystal display device of the comparative example. FIG. 7 is a timing chart illustrating the relation of signals of the liquid crystal display device of the comparative example. FIG. 6 corresponds to FIG. 1. FIG. 7 corresponds to FIG. 2.

In the liquid crystal display device 1 of the present embodiment, bit inversion and non-inversion are performed for the video data VD. However, the liquid crystal display device of the comparative example is different in that bit inversion and non-inversion are performed for the ramp waveform. In this regard, differences with the liquid crystal display device 1 of the present embodiment will be described. In order to simplify the description, the same reference numerals are used to designate the same elements as those of the liquid crystal display device 1.

As illustrated in FIG. 6, the liquid crystal display device 501 includes a timing generation circuit 502, a ramp waveform signal generation circuit 520, and the liquid crystal display element 30.

The timing generation circuit 502 receives the frame synchronization signal FD, the clock signal CLK, the horizontal synchronization signal SHD, and the vertical synchronization signal SVD. The timing generation circuit 502 generates a frame signal FS which is synchronized with the frame synchronization signal FD, and outputs the frame signal FS, the counter reset signal CR, and the counter clock signal CCLK to the ramp waveform signal generation circuit 520.

Figure 8:
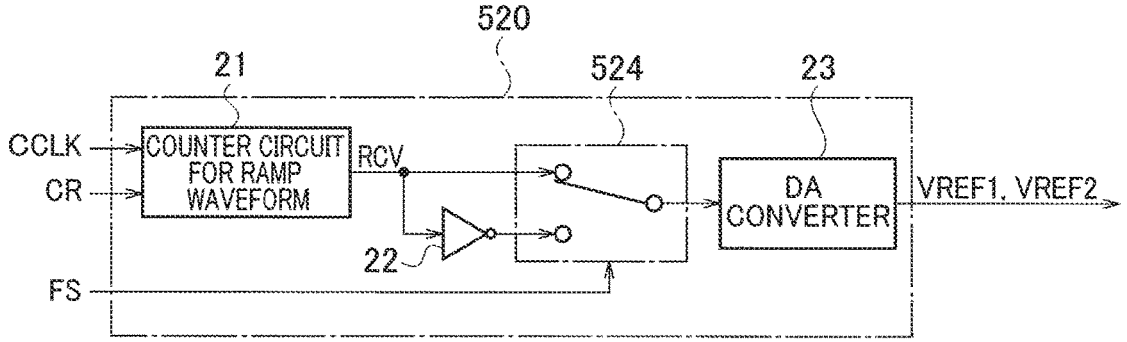
FIG. 8 is a configuration diagram illustrating a ramp waveform signal generation circuit of the liquid crystal display device of the comparative example.

As illustrated in FIG. 8, the ramp waveform signal generation circuit 520 has the counter circuit 21 for a ramp waveform, the inverter 22, a switching switch 524, and the DA converter 23. FIG. 8 corresponds to FIG. 4. The counter circuit 21 for a ramp waveform receives the counter clock signal CCLK and the counter reset signal CR. The counter reset signal CR is inputted, so that the counter circuit 21 for a ramp waveform is reset. The switching switch 524 receives the frame signal FS.

When FS is 0, the switching switch 524 connects the counter circuit 21 for a ramp waveform and the DA converter to each other. The counter circuit 21 for a ramp waveform is reset, counts up the counter clock signal CCLK, and then outputs the count value RCV for a ramp waveform to the DA converter 23 via the switching switch 524.

When FS is 1, the switching switch 524 connects the counter circuit 21 for a ramp waveform and the DA converter 23 to each other via the inverter 22. The counter circuit 21 for a ramp waveform is reset, counts up the counter clock signal CCLK, and then outputs the count value RCV for a ramp waveform to the inverter 22. The inverter 22 performs bit inversion of the count value RCV for a ramp waveform and outputs a resultant to the DA converter 23 via the switching switch 524.

The DA converter 23 performs DA conversion of the count value RCV for a ramp waveform subjected to no bit inversion (non-inversion), thereby generating a ramp waveform signal VREF1 which is an analog signal having a ramp waveform of a normal sawtooth wave having a voltage which gently rises and then rapidly falls. Then, the DA converter 23 outputs the ramp waveform signal VREF1 to the selection circuits 205 (2051 to 205*x*) of the horizontal scanning circuit 200 of the liquid crystal display element 30. As illustrated in the timing chart (k) of FIG. 7, the ramp waveform signal VREF1 has an analog ramp waveform of a periodic sweep signal which changes in a voltage rising direction from the low voltage level V0 of black display to the high voltage level V1 of white display in the pixel 110 with a cycle of one horizontal scanning period.

The DA converter 23 performs DA conversion of the count value RCV for a ramp waveform subjected to the bit inversion, thereby generating a ramp waveform signal VREF2 which is an analog signal having a ramp waveform of a reverse sawtooth wave, having a voltage which gently falls and then rapidly rises. Then, the DA converter 23 outputs the ramp waveform signal VREF2 to the selection circuits 205 (2051 to 205*x*) of the horizontal scanning circuit 200 of the liquid crystal display element 30. As illustrated in the timing chart (m) of FIG. 7, the ramp waveform signal VREF2 has an analog ramp waveform of a periodic sweep signal which changes in a voltage falling direction from the high voltage level V1 of white display to the low voltage level V0 of black display in the pixel 110 with a cycle of one horizontal scanning period.

As illustrated in FIG. 6, to the shift resister 201, the video data VD is inputted. Furthermore, to the shift resister 201, the shift clock signal SCLK is inputted from the timing generation circuit 502. Based on the shift clock signal SCLK, the shift resister 201 sequentially inputs the video data VD as a gradation signal DL illustrated in a timing chart (e) of FIG. 7, and corresponding to x pixels 110 of one row scanning line G in units of one horizontal scanning period. The gradation signal DL has n-bit gradation data. For example, when n is 10, an image can be displayed with 1,024 gradations for each pixel 110.

The shift resister 201 sequentially inputs the n-bit gradation data in a parallel manner and shifts the n-bit gradation data. Based on the latch signal SL, the latch circuit 202 receives the gradation signal DL corresponding to x pixels 110 of one row scanning line G from the shift resister 201. The latch circuit 202 holds the n-bit gradation data corresponding to each of the received x pixels 110 in the next one horizontal scanning period.

To each comparator circuit 204, the count value QD is inputted from the counter circuit 203 and the gradation signal DL corresponding to the pixels 110 is inputted from the latch circuit 202. Each comparator circuit 204 compares the gradation data of the gradation signal DL with the count value QD for each bit, generates a coincident pulse signal AP illustrated in the timing chart (j) of FIG. 7 when both of them coincide with each other, and outputs the coincident pulse signal AP to a corresponding selection circuit 205. When the gradation value of the gradation signal DL is 3, the comparator circuit 204 outputs the coincident pulse signal AP to the selection circuit 205 at a timing at which the count value QD is 3.

To each selection circuit 205, the coincident pulse signal AP is inputted from the corresponding comparator circuits 204, and the all-pixel reset signal SELRST is inputted from the timing generation circuit 502. Furthermore, to each selection circuit 205, the ramp waveform signals VREF1 and VREF2 are inputted from the ramp waveform signal generation circuit 520.

When the all-pixel reset signal SELRST is inputted from the timing generation circuit 502 during one horizontal blanking period, each analog switch is turned on, so that each selection circuit 205 starts sampling of the ramp waveform signals VREF1 and VREF2. When each analog switch is turned off at a falling timing of the coincident pulse signal AP, each selection circuit 205 ends the sampling.

The selection circuits 205 respectively outputs the sampled ramp waveform signals VREF1 and VREF2 to corresponding column data lines D as driving voltages VID11 and VID12 (analog voltages) during a period from the input of the all-pixel reset signal SELRST to the falling of the coincident pulse signal AP in units of one horizontal scanning period. The selection circuits 205 end the sampling at the falling timing of the coincident pulse signal AP, thereby deciding the driving voltages VID11 and VID12 to be outputted to the column data line D1. For example, the selection circuit 2051 outputs the sampled ramp waveform signals VREF1 and VREF2 to the column data line D1 as the driving voltages VID11 and VID12 at the falling timing of the coincident pulse signal AP are outputted from the comparator circuit 2041.

When the ramp waveform signal VREF1 of a normal sawtooth wave which is not subjected to the bit inversion, is inputted, the selection circuit 205 performs sampling to the high gradation (white) from the low gradation (black). Furthermore, when the ramp waveform signal VREF2 of a reverse sawtooth wave which is subjected to the bit inversion, is inputted, the selection circuit 205 performs sampling to the low gradation (black) from the high gradation (white). In this way, the driving voltage VID11 and the driving voltage VID12 are alternately applied to the pixel electrode 113 of the liquid crystal driving section 112 in units of frames, so that the liquid crystal 114 can be AC-driven.

Figure 9:
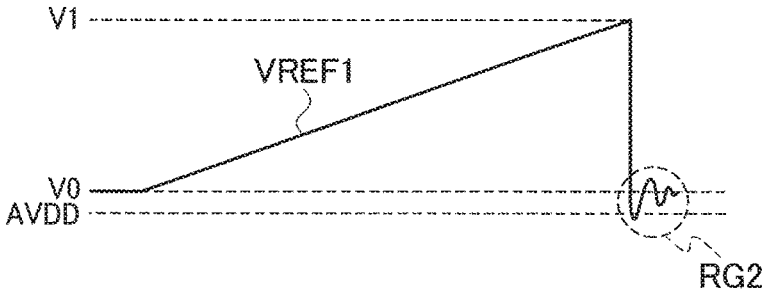
FIG. 9 is a diagram for explaining ringing occurring in a ramp waveform signal.

Ringing which occurs in the ramp waveform signal VREF1 will be described using FIG. 9. The ramp waveform signal VREF1 gently rises from the low voltage level V0 to the high voltage level V1, and then rapidly falls to the low voltage level V0. When the ramp waveform signal VREF1 rapidly rises to the low voltage level V0 from the high voltage level V1, ringing RG2 occurs.

In order to drive the liquid crystal 114 with a modulation degree of a full scale of 0% to 100%, the low voltage level V0 is set in the vicinity of the potential AVDD of the low potential side power supply AVCC. Therefore, there is a case where a maximum amplitude of the ringing RG2 which occurs in the ramp waveform signal VREF1 exceeds the potential AVDD, that is, a minimum potential of the maximum amplitude of the ringing RG2 is lower than the potential AVDD.

When the maximum amplitude of the ringing RG2 exceeds the potential AVDD, a latch-up occurs in the diode 402 connected to the low potential side power supply AVCC of the protection diode circuit 400. In order to prevent the latch-up from occurring in the diode 402, it is necessary to set the low voltage level V0 of the ramp waveform signal VREF1 to be high. When the low voltage level V0 is set to be high, since it is not possible to drive the liquid crystal 114 with the modulation degree of the full scale, a dynamic range of contrast of a display image becomes narrow.

In addition, when the ramp waveform signal VREF2 rapidly rises to the high voltage level V1 from the low voltage level V0, ringing RG1 occurs. However, similarly to the ramp waveform signal VREF of the liquid crystal display device 1 of the present embodiment, the high voltage level V1 of the ramp waveform signal VREF2 is set to a voltage level ($V1<(DVDD-V_{th})$) lower than the potential ($DVDD-V_{th}$). In this way, even though the ringing RG1 occurs when the ramp waveform signal VREF2 rapidly rises to the high voltage level V1 from the low voltage level V0, it is possible to suppress the maximum amplitude of the ringing RG1 in a range from the potential DVDD to the potential ($DVDD-V_{th}$), so that it is possible to normally operate the pixel selection transistor 111.

In the liquid crystal display device 501 of the comparative example, the liquid crystal 114 is AC-driven using the ramp waveform signal VREF1 having a ramp waveform of a normal sawtooth wave, and the ramp waveform signal VREF2 having a ramp waveform of a reverse sawtooth wave. In order to prevent latch-up from occurring in the diode 402 of the protection diode circuit 400, since the low voltage level V0 of the ramp waveform signal VREF1 is set to be high, the dynamic range of the contrast of the display image becomes narrow.

However, in the liquid crystal display device 1 of the present embodiment, one ramp waveform, specifically, only the ramp waveform signal VREF having a ramp waveform of a reverse sawtooth wave is used, and the liquid crystal 114 is AC-driven using the non-inverted video signal VDS1 in which the video data VD is not bit-inverted, and the inverted video signal VDS2 in which the video data VD is bit-inverted.

Accordingly, the liquid crystal 114 is AC-driven without using the other ramp waveform, specifically, the ramp waveform signal VREF2 having a ramp waveform of a normal sawtooth wave, so that it is possible to prevent deterioration of the dynamic range of the contrast of the display image. Thus, according to the liquid crystal display device 1 of the present embodiment, the liquid crystal is AC-driven, so that it is possible to display an image while maintaining contrast of a wide dynamic range.

Note that the present invention is not limited to the configuration of the aforementioned embodiment and various modifications can be made within the scope of the present invention.

For example, in the liquid crystal display device 1 of the present embodiment, a configuration in which the NMOS transistor is used as the pixel selection transistor 111 has been described; however, it may be possible to employ a configuration of using a PMOS transistor. When the PMOS transistor is used as the pixel selection transistor 111, the ramp waveform signal generation circuit 20 does not have the inverter 22.

In this way, the ramp waveform signal generation circuit 20 generates the ramp waveform signal VREF having a voltage gently rising and then rapidly falling, and a ramp waveform of a normal sawtooth wave. The ramp waveform signal VREF has an analog ramp waveform of a periodic sweep signal which changes in a voltage rising direction from the low voltage level V0 of black display to the high voltage level V1 of white display in the pixel 110 with a cycle of one horizontal scanning period.

The gate signal GS is inputted to the pixel selection transistor 111 at a signal level from the high potential DVDD to the low potential AVDD. On the other hand, when the driving voltages VID1 and VID2 inputted to the drain exceed the threshold value $V_{th}$ of the pixel selection transistor 111, the pixel selection transistor 111 does not operate normally.

Accordingly, in order to allow the pixel selection transistor 111 to operate normally, the driving voltages VID1 and VID2 are inputted to the pixel selection transistor 111 at a signal level from the potential (AVDD+$V_{th}$) to the potential DVDD. Therefore, the low voltage level V0 of the ramp waveform signal VREF is set to a voltage level (V0>(AVDD+$V_{th}$)) higher than the potential (AVDD+$V_{th}$). In this way, even though the ringing RG2 occurs when the ramp waveform signal VREF rapidly falls to the low voltage level V0 from the high voltage level V1, it is possible to suppress the maximum amplitude of the ringing RG2 in a range from the potential AVDD to the potential (AVDD+$V_{th}$), so that it is possible to normally operate the pixel selection transistor 111.

DRAWINGS

FIG. 1
10 VIDEO SIGNAL PROCESSOR
2 TIMING GENERATION CIRCUIT
20 RAMP WAVEFORM SIGNAL GENERATION CIRCUIT
203 COUNTER CIRCUIT
30 LIQUID CRYSTAL DISPLAY ELEMENT
201 SHIFT RESISTER
202 LATCH CIRCUIT
2041 COMPARATOR CIRCUIT
2042 COMPARATOR CIRCUIT
204*x* COMPARATOR CIRCUIT
2051 SELECTION CIRCUIT
2052 SELECTION CIRCUIT
205*x* SELECTION CIRCUIT
300 VERTICAL SCANNING CIRCUIT
FIG. 4
21 COUNTER CIRCUIT FOR RAMP WAVEFORM
23 DA CONVERTER
FIG. 6
502 TIMING GENERATION CIRCUIT
520 RAMP WAVEFORM SIGNAL GENERATION CIRCUIT
203 COUNTER CIRCUIT
30 LIQUID CRYSTAL DISPLAY ELEMENT
201 SHIFT RESISTER
202 LATCH CIRCUIT
2041 COMPARATOR CIRCUIT
2042 COMPARATOR CIRCUIT
204*x* COMPARATOR CIRCUIT
2051 SELECTION CIRCUIT
2052 SELECTION CIRCUIT
205*x* SELECTION CIRCUIT
300 VERTICAL SCANNING CIRCUIT
FIG. 8
21 COUNTER CIRCUIT FOR RAMP WAVEFORM
23 DA CONVERTER

What is claimed is:

1. A liquid crystal display device comprising:

a video signal processor configured to generate a non-inverted video signal in which video data is not bit-inverted and an inverted video signal in which the video data is bit-inverted;

a ramp waveform signal generation circuit configured to generate a ramp waveform signal having a ramp waveform of a sawtooth wave; and a liquid crystal display element in which a plurality of pixels having a liquid crystal are arranged, and a first driving voltage decided based on the non-inverted video signal and the ramp waveform signal, and a second driving voltage decided based on the inverted video signal and the ramp waveform signal are alternately applied to the liquid crystal, wherein the video signal processor comprises:

an inverter configured to generate the inverted video signal by performing bit inversion of the video data; and a switch configured to switch the non-inverted video signal in which the video data is not bit-inverted and the inverted video signal generated by the inverter, and to output the switched signal to the liquid crystal display element.

* * * * *